US006602170B2

(12) United States Patent
Ilic

(10) Patent No.: US 6,602,170 B2
(45) Date of Patent: Aug. 5, 2003

(54) FULL BODY EXERCISER

(76) Inventor: Dragan Z. Ilic, 104 Main St., Bloomingdale, NJ (US) 07403

( * ) Notice: Subject to any disclaimer, the term of this patent is extended or adjusted under 35 U.S.C. 154(b) by 198 days.

(21) Appl. No.: 09/839,266

(22) Filed: Apr. 23, 2001

(65) Prior Publication Data

US 2002/0155932 A1 Oct. 24, 2002

(51) Int. Cl.[7] ..... A63B 21/00
(52) U.S. Cl. ..... 482/132; 482/907; 482/141
(58) Field of Search ..... 280/87.01, 87.021, 280/87.042, 79.11, 79.3, 79.4; 482/907, 145–147, 121–130, 132

(56) References Cited

U.S. PATENT DOCUMENTS 3,436,088 A * 4/1969 Kunselman
4,127,202 A * 11/1978 Jennings et al.
5,052,703 A * 10/1991 Betrand
5,458,351 A * 10/1995 Yu
6,394,470 B1 * 5/2002 Shirai

* cited by examiner

*Primary Examiner*—Jerome W. Donnelly
(74) *Attorney, Agent, or Firm*—Salzman & Levy

(57) ABSTRACT

A torso exercising apparatus and system for performing various calisthenics and maneuvers to tone and build the body. Right and left handles of the apparatus are disposed between two respective pairs of spaced-apart, front and rear rollers. Each of the roller pairs is affixed to a base. The handles are each disposed on a diagonal with respect to their respective front and rear roller pairs. The diagonally oriented handles eliminate wrist strain and have a further advantage of facilitating sideways movement.

12 Claims, 16 Drawing Sheets

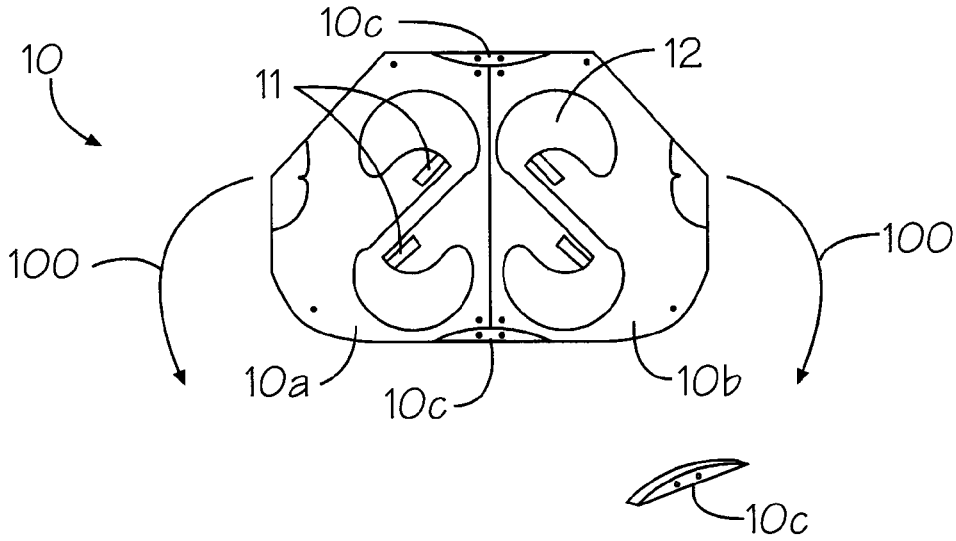
Figure 1a
Figure 1b
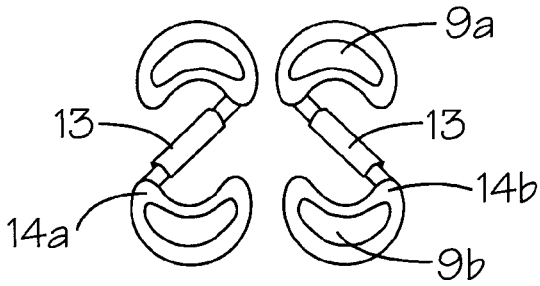
Figure 1c
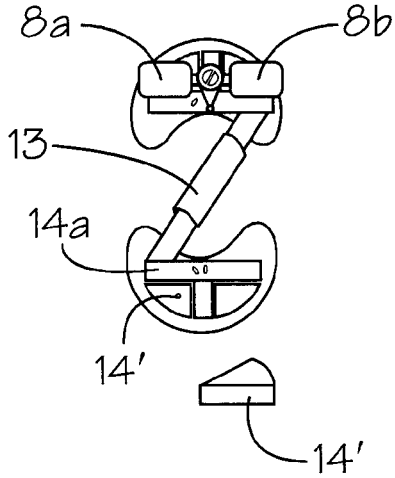

FULL BODY EXERCISER

FIELD OF THE INVENTION

The present invention relates to home exercise equipment and, more particularly, to an exercise system that reduces wrist strain during work-out sequences and provides a facile means by which to vary the exercise program.

BACKGROUND OF THE INVENTION

In recent times, the use of home devices to improve upper torso strength has become very popular. These devices often comprise a housing that rolls upon the floor. A longitudinally disposed handle is provided for gripping the housing. As the user leans his or her body weight against the device, the housing rolls forward and the muscles in the torso are stressed. Such an instrumentality is illustrated in U.S. Pat. No. 5,632,707, issued to Daniel et al., on May 27, 1997, for UPPER TORSO EXERCISER. The handle orientation is stressful upon the wrist during the exercises.

Another similar device is shown in U.S. Pat No. 3,752, 475, issued to Ott on Aug. 14, 1973, for AXLE-MOUNTED WHEEL EXERCISING DEVICE WITH SPRING LOADED RESISTANCE LOCATED CENTRALLY WITHIN THE WHEEL. The wheel is rolled upon the floor by gripping the axle-handle and pushing the wheel forward. A spring contained within the wheel biases the forward movement, thus causing stress to be exerted upon the torso muscles, as the wheel is rolled forward.

In still another exercising device, swivel casters are symmetrically fixed about a longitudinally disposed handle, as illustrated in U.S. Pat. No. 3,809,393, issued to Jones on May 7, 1974, for SWIVEL CASTER SUPPORTED EXERCISING HANDLE APPARATUS. One of the problems with using swivels, however, is the difficulty in moving the device in a straight line. The swivels tend to stray from a given forward movement, thus causing strain upon the wrists of the exerciser.

In yet another torso exerciser, a handle-axle is disposed between two spaced-apart wheels, as depicted in U.S. Pat. No. 5,222,930, issued to Bold, Jr., on Jun. 29, 1993, for INERTIAL FORCE EXERCISE DEVICE HAVING DENSE BODY EXTREMITIES.

The present invention features a device similar to the aforesaid torso exercisers. The device features two roller bases that can be gripped by a respective handle. The handle of each roller base is disposed between two pairs of spaced-apart, front and rear rollers, each of which can be turned, relative to the major axis of the roller base. The handles are disposed on a diagonal with respect to their respective front and rear roller pairs. The diagonally oriented handles eliminate wrist strain and have the further advantage of facilitating sideways movement.

In addition to providing a more facile torso exercising device, the roller pairs nest within a platform. The platform acts as a knee-rest for the torso exercises. On the top side of the platform is a layer of foam, on which the knees can be placed. This provides a stable platform that anchors the knees of the person as he bends forward and performs his torso routines. In another embodiment of the invention, the roller base and handle are sufficiently weighted so that they can be used as free-weight barbells. Thus, the torso apparatus of the invention can provide a complete upper and lower body exercise program.

SUMMARY OF THE INVENTION

In accordance with the present invention, there is provided a torso exercising apparatus. The apparatus is designed to provide a complete torso and upper body exercise system. The apparatus comprises two handles that are each disposed between two pairs of spaced-apart, front and rear rollers, respectively. Each of the roller pairs is affixed to a base. The handles are each disposed on a diagonal with respect to their respective front and rear roller pairs. The diagonally oriented handles eliminate wrist strain and have the further advantage of facilitating sideways movement.

In addition to providing a more facile torso exercising device, the roller pairs and bases, forming two roller bases, each nest within a platform. The platform acts as a knee-rest for the torso exercises. A layer of foam disposed on the top surface of the platform has voids in which knees can be placed. This provides a stable platform that anchors the knees of the person as he bends forward and performs his torso routines. In another embodiment of the invention, the roller bases and handles are sufficiently weighted so that they can be used as barbells.

It is an object of the present invention to provide an improved torso and upper body, home exercising apparatus.

It is another object of this invention to provide a home exercising apparatus wherein certain ones of the exercise parts nest within each other to provide a compact exercising system.

It is a further object of the invention to provide a torso exercising apparatus, whose handles reduce and/or eliminate wrist strain and which further facilitate sideways movement of the apparatus rollers upon the floor.

BRIEF DESCRIPTION OF THE DRAWINGS

A complete understanding of the present invention may be obtained by reference to the accompanying drawings, when considered in conjunction with the subsequent detailed description, in which:

FIGS. 1*a,* 1*b* and 1*c* illustrate a plan view of the two-part platform and roller pairs that form the exercise apparatus of this invention;

For purposes of brevity and clarity, like elements and components will bear the same number and designation throughout the figures.

DETAILED DESCRIPTION OF THE PREFERRED EMBODIMENT

Generally speaking, the invention features a torso exercising apparatus and system for performing various calisthenics and maneuvers to tone and build the body. Two right and left handles of the apparatus are disposed between two respective pairs of spaced-apart, front and rear rollers. Each of the roller pairs is affixed to respective bases, forming two roller bases. The handles are each disposed on a diagonal with respect to their respective front and rear roller pairs. The diagonally oriented handles eliminate wrist strain and have the further advantage of facilitating sideways movement.

Figure 1D:
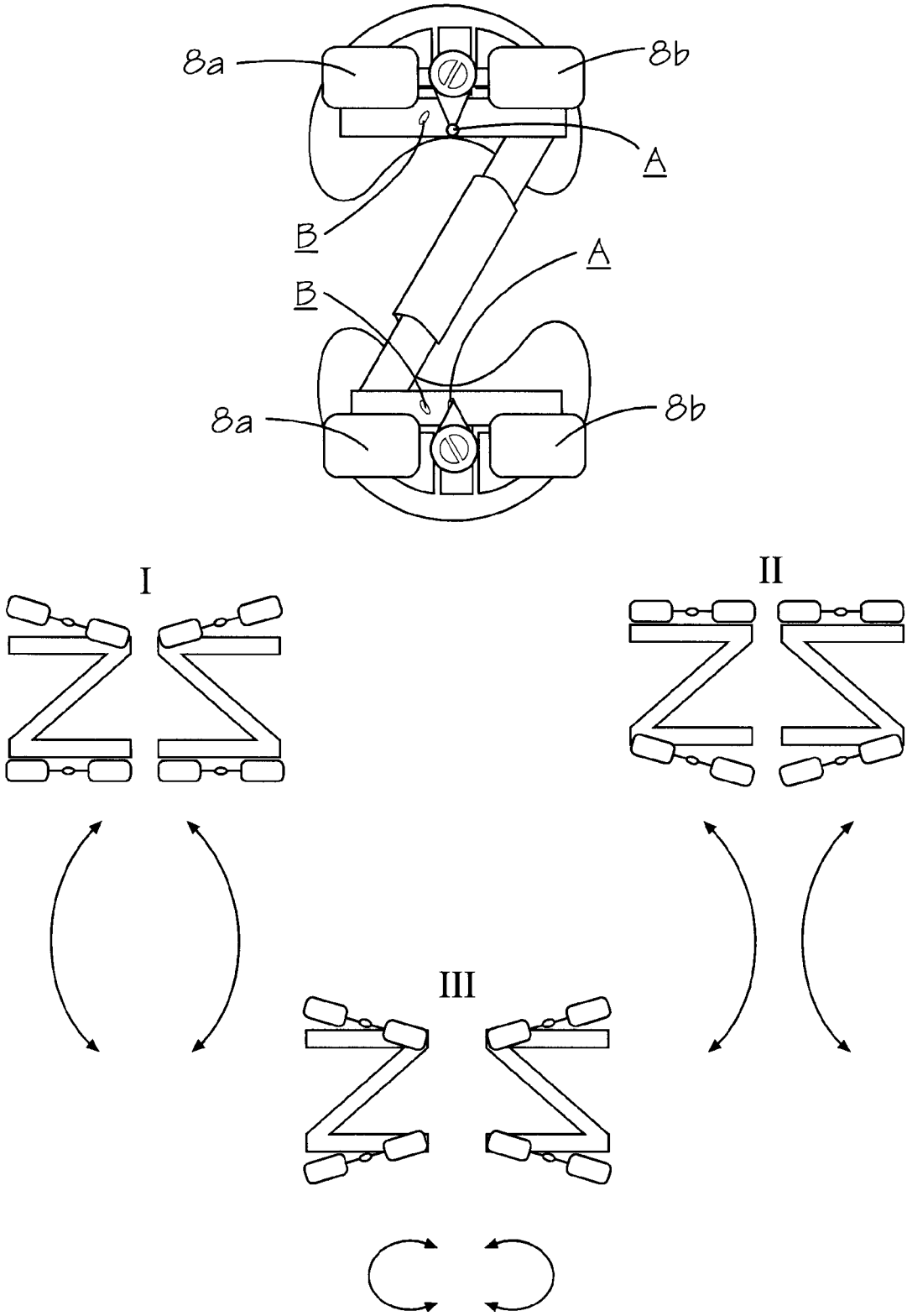
FIG. 1*d* is a schematic depiction of roller pairs in various orientations relative to the roller base.

Now referring to FIG. 1*a*, a stationary platform 10 of the inventive apparatus is shown. The lower surface of the stationary platform 10 has two contoured holes 12, which, by means of respective pivotable retention clips 11, accommodate a pair of hand-held torso exercise roller bases 14*a* and 14*b* (FIG. 1*b*), respectively. Platform 10 comprises two halves 10*a* and 10*b* connected to one another by means of respective connecting hardware 10*c*. The connecting hardware 10*c* can be removed, as required, to separate the halves 10*a* and 10*b*, as shown by arrows 100, of platform 10 for storage and transportation purposes.

Referring to FIGS. 1*b* and 1*c*, each roller base 14*a* or 14*b*, has a pair of rollers 8*a* and 8*b*, respectively. The handle portion 13 of the respective roller bases 14*a* and 14*b* spans the forward and rear roller portions 9*a* and 9*b*, respectively, with a diagonal orientation. Removable weights 14', preferably approximately 1 to 3 pounds, can be inserted as shown in FIG. 1*c*, affixed by hook and loop material, so that the roller base 14*a*, 14*b* can be used as free weights for various exercises.

Figure 2A:
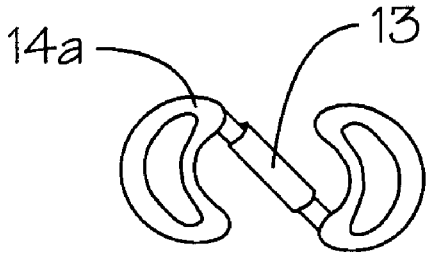
FIGS. 2*a* through 2*c* depict top, front, and side views, respectively, of the roller pairs of the apparatus shown in FIGS. 1*a*–1*c;*
Figure 2B:
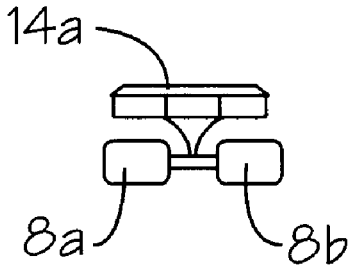
Figure 2C:
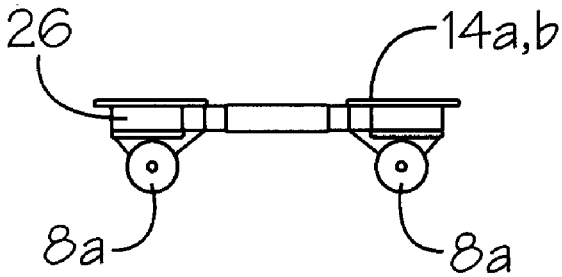

Rollers 8*a* and 8*b* can be moved from a straight position A (FIG. 1*d*) to an angled position B for use described in greater detail with reference to FIGS. 10*a* and 10*b*. The various configurations of rollers 8*a*, 8*b* with respect to roller base 14*a*, 14*b* are depicted schematically in FIG. 1*d*, while the torso exercise roller bases 14*a*, 14*b* are shown in greater detail in FIGS. 2*a* through 2*c*.

Figure 3A:
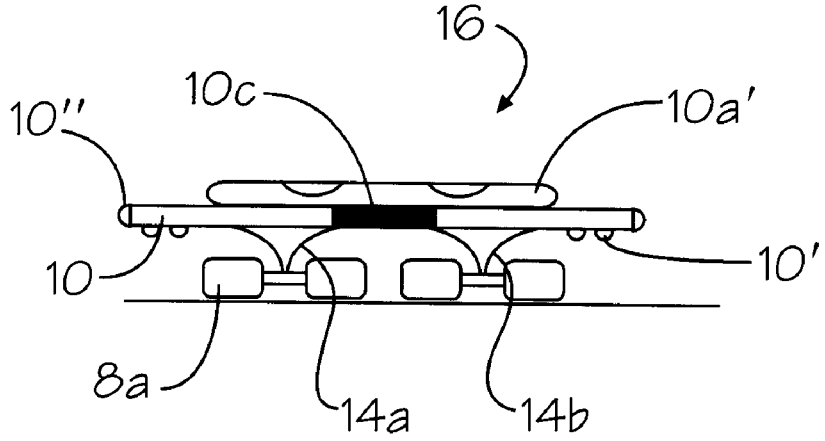
FIGS. 3*a* and 3*b* show a front view of the roller pairs of FIGS. 1*a*–1*c,* nesting within the platform.
Figure 3B:
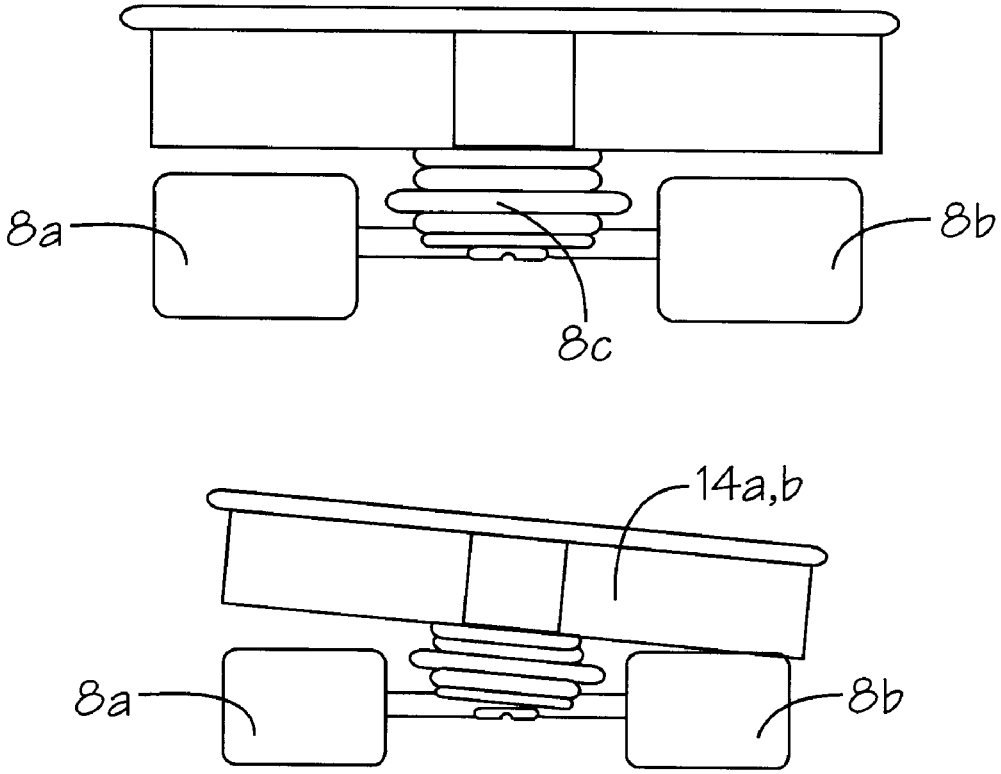

Referring to FIGS. 3*a* and 3*b*, a front view is shown of the stationary platform 10 with the roller bases 14*a* and 14*b* nested within the holes 12 therein, to form a rolling platform 16. Four feet or pads 10' are attached to the lower, cutout surface of platform 10. A foam cushion layer 10*a*' is also contoured for a user's knees and is attached to the opposite (upper) side of platform 10. At the extreme edges of platform 10 are disposed two hand cushions 10".

A resilient pair of bushings 8*c* provides a flexible, cushioning effect to rollers 8*a* and 8*b* and allows them to operate at an angle relative to the major axis of the roller bases 14*a* and 14*b*.

Figure 4A:
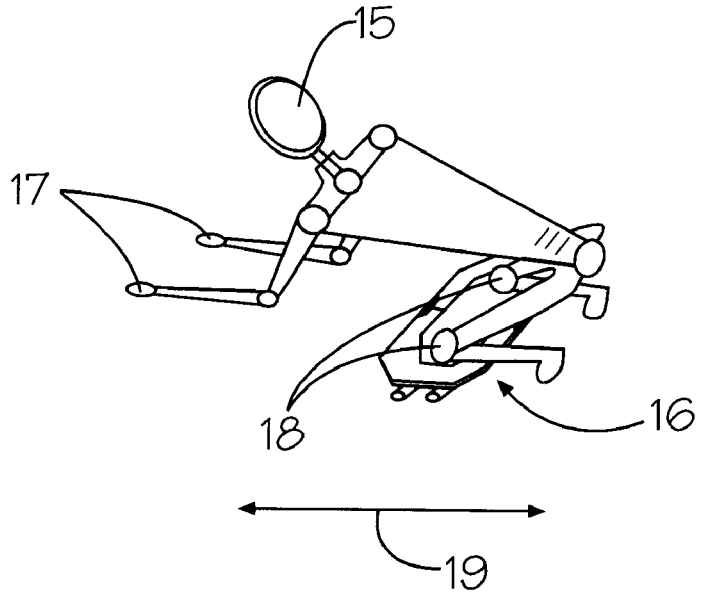
FIGS. 4*a* and 4*b* illustrate perspective, schematic views of an individual kneeling upon the platform and using the platform to exercise and stretch the lower body.
Figure 4B:
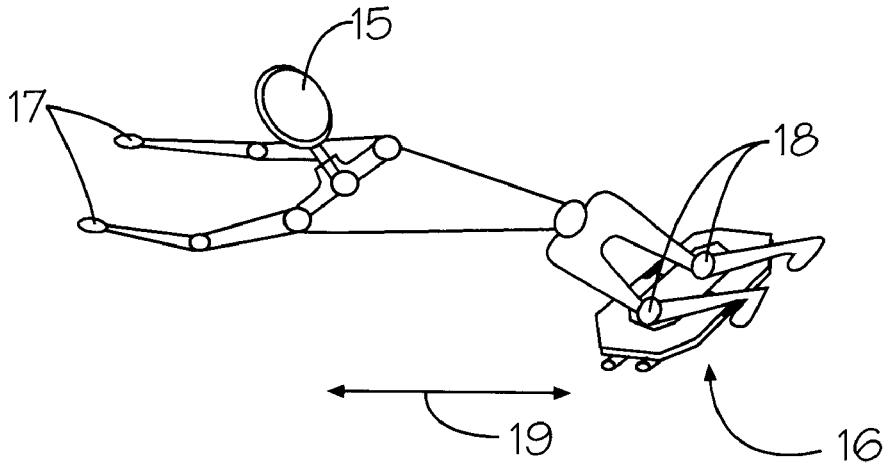

Referring to FIGS. 4*a* and 4*b*, an individual 15 is shown kneeling upon the rolling platform 16 of FIG. 3*a*. The individual 15 uses the rolling platform 16 to exercise the lower torso, by bracing his or her hands 17 on the floor, and using his or her knees 18 to push the rolling platform 16 back and forth, as illustrated by arrows 19.

Figure 5A:
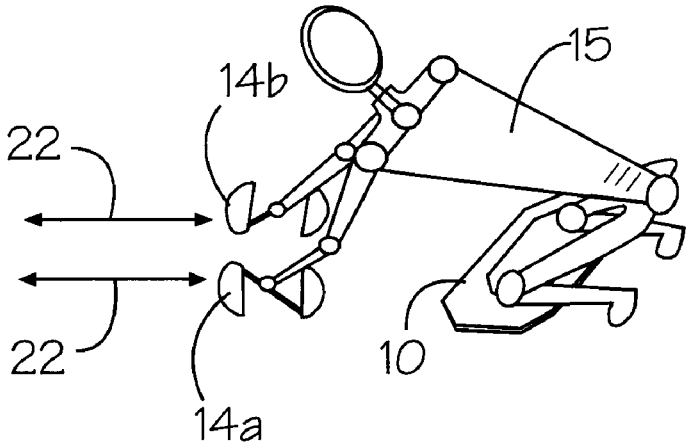
FIGS. 5*a* through 5*d* depict schematic perspective, top and front views of an individual using the apparatus of FIGS. 1*a*–1*c* to exercise the upper torso of the body.
Figure 5B:
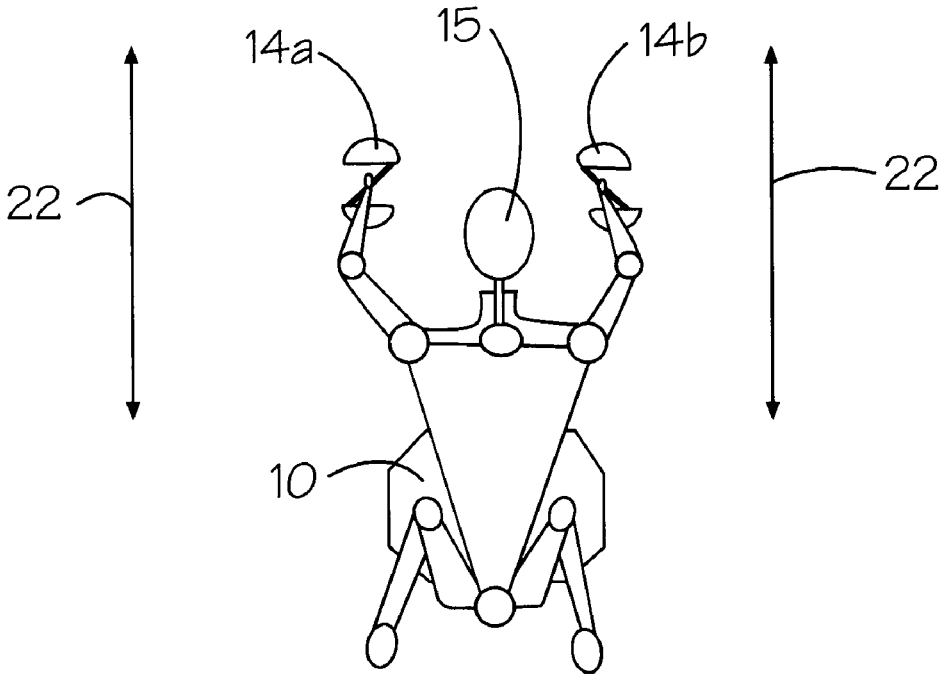
Figure 5C:
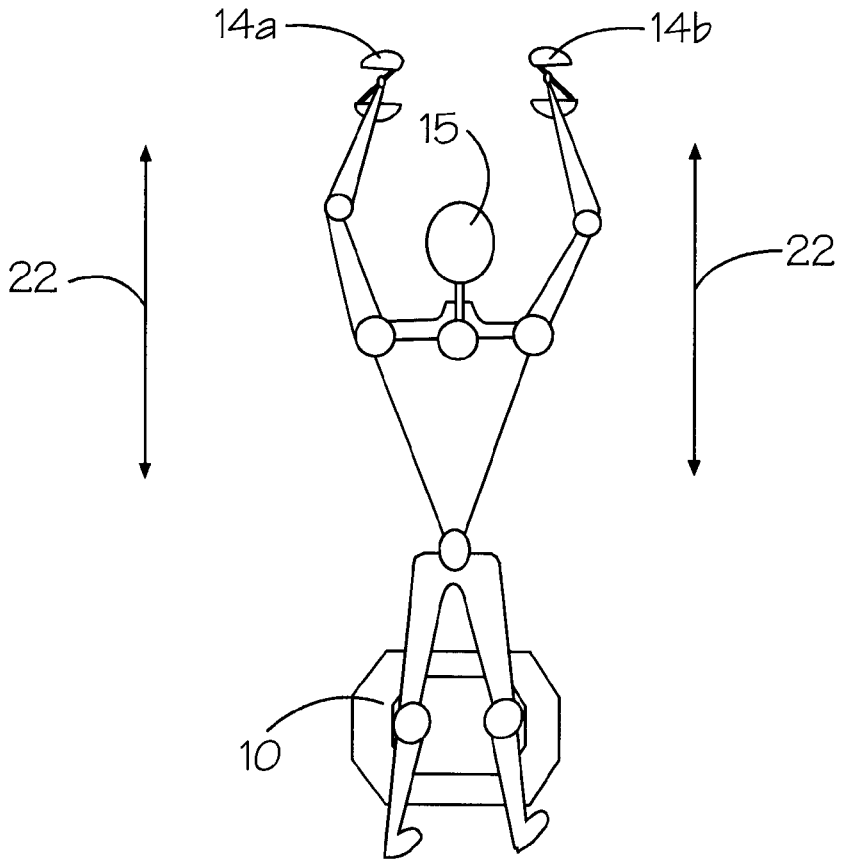
Figure 5D:
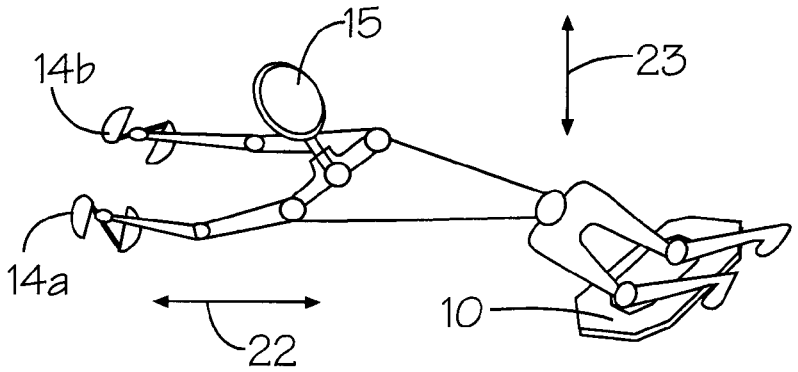
Figure 6A:
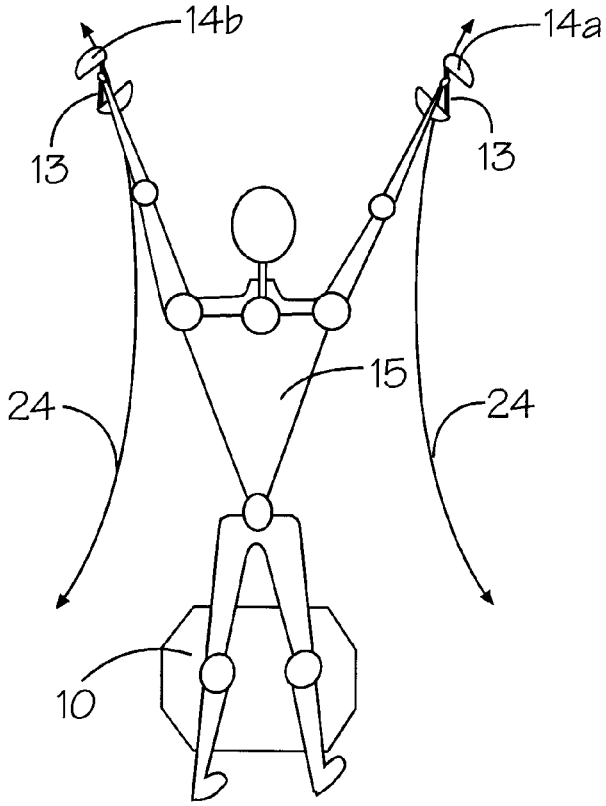
FIGS. 6*a* through 6*b* show schematic top views of an individual using the apparatus of FIGS. 1*a*–1*c* to exercise the upper torso in alternate exercises.
Figure 6B:
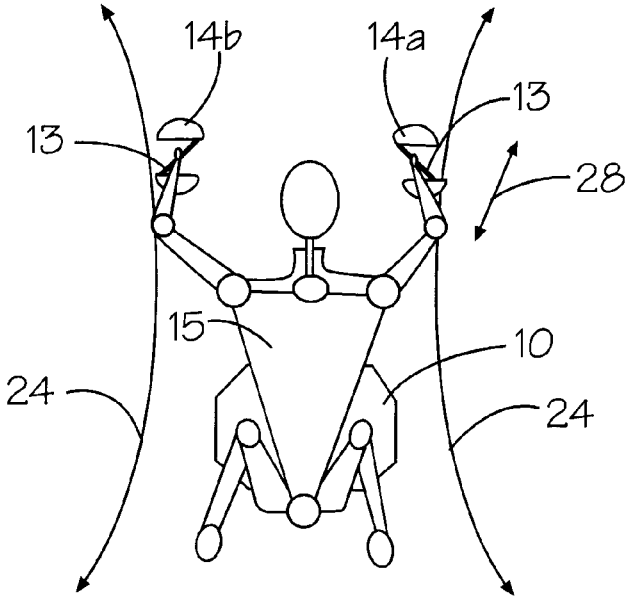
Figure 6C:
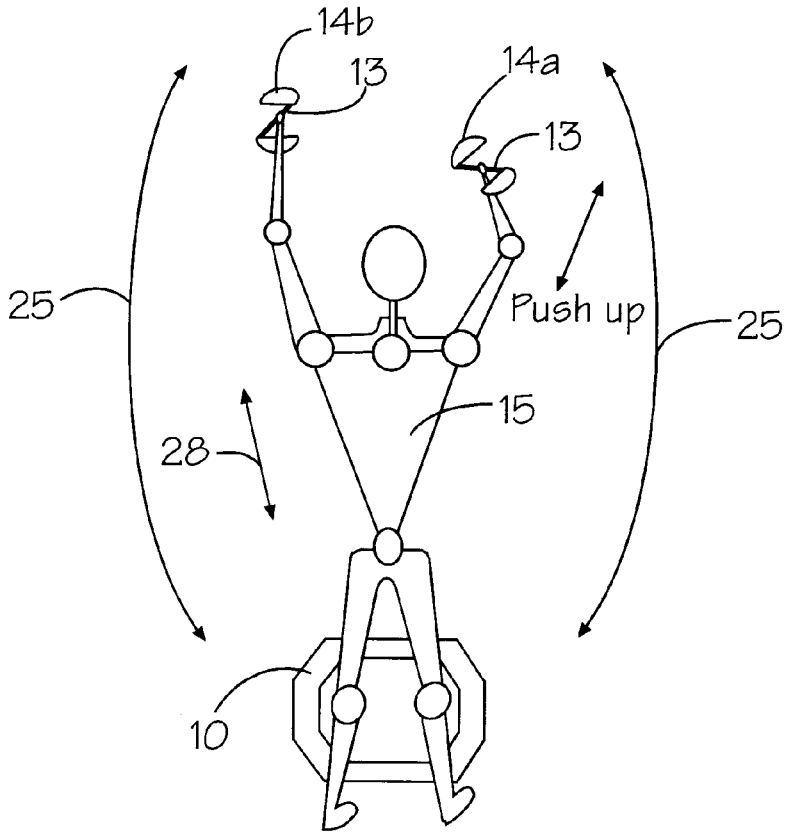
Figure 6D:
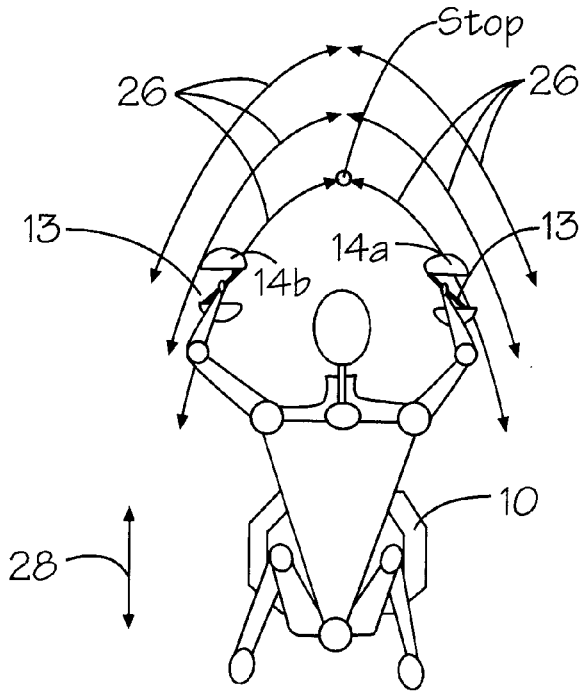
Figure 7A:
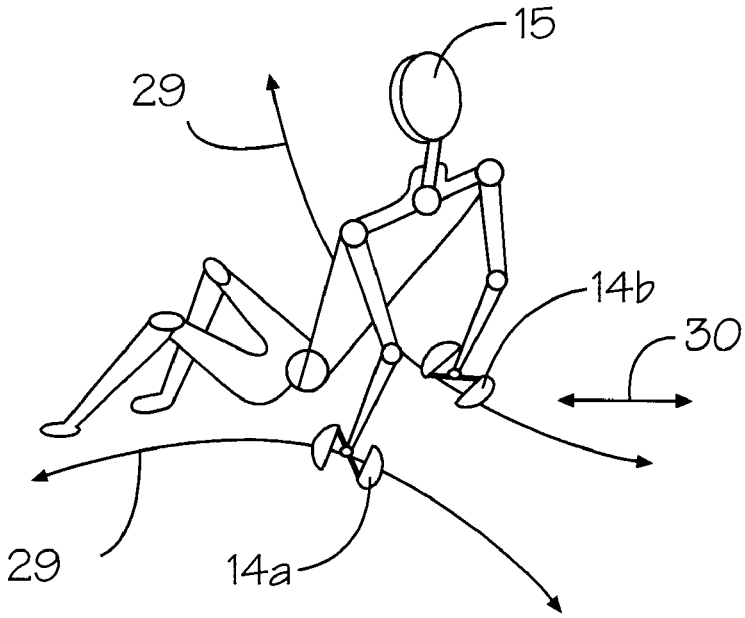
FIGS. 7*a* through 7*d* illustrate schematic, perspective views of an individual using the apparatus of FIGS. 1*a*–1*c* to exercise the back and shoulder areas of the body.
Figure 7B:
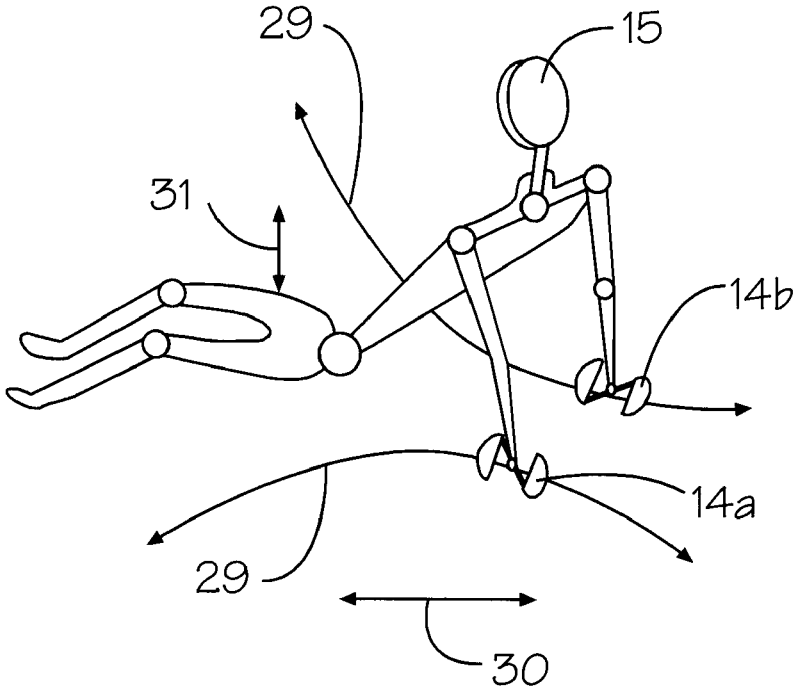
Figure 7C:
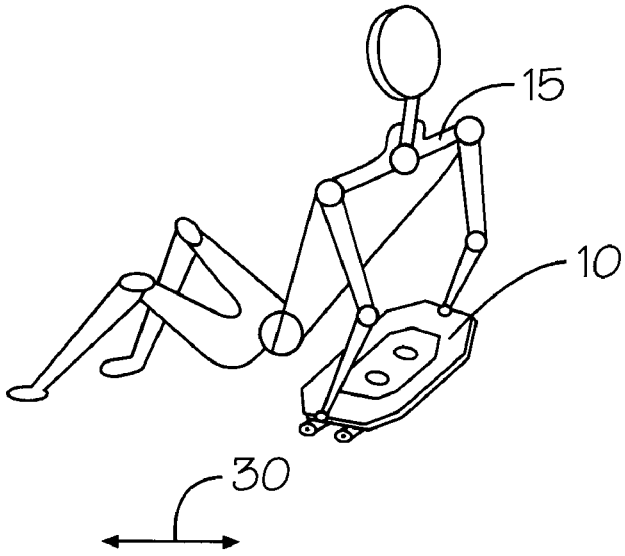
Figure 7D:
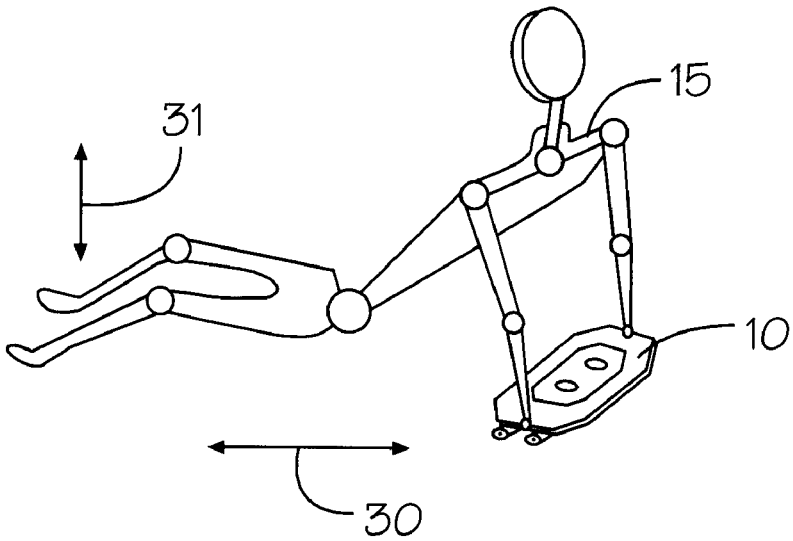

Referring to FIGS. 5*a* through 5*d*, an individual 15 is depicted using the stationary platform 10 and the exercise torso roller bases 14*a* and 14*b*, respectively, to perform a number of maneuvers. The individual 15 in FIGS. 5*a* through 5*d* is shown kneeling upon stationary platform 10, and using the roller bases 14*a* and 14*b* to move back and forth, as illustrated by arrows 22. In FIG. 5*d* the individual is shown using a pelvic lift maneuver, wherein the torso is pushed up and down, as shown by arrows 23.

Referring to FIGS. 6*a* through 6*d*, an individual 15 is illustrated using several different maneuvers with sideways movement. The diagonal handles 13 of the roller bases 14*a* and 14*b*, respectively, provide two benefits: a) they eliminate, or greatly reduce wrist strain, when doing intricate maneuvers, as suggested here, and b) they also enable the roller bases 14*a* and 14*b* to more easily move in sideways directions, as shown by arrows 24, 25, and 26. In addition to moving the roller bases 14*a* and 14*b*, the individual 15 can also move his body in a back and forth motion, as shown by arrows 28.

Referring to FIGS. 7*a* through 7*d*, the individual 15 can use the roller bases 14*a* and 14*b* as rolling supports for a backward exercise. The roller bases 14*a* and 14*b* are moveable in an arcuate or sideways maneuver (FIGS. 7*a* and 7*b*), as shown by arrows 29. In addition to movement of the roller bases 14*a*, 14*b*, the individual 15 can move his body back and forth, as shown by arrows 30, and up and down, as shown by arrows 31. The entire base 10 can be used (FIGS. 7*c* and 7*d*) for more stability and less pressure on the shoulders of the user 15.

Figure 8A:
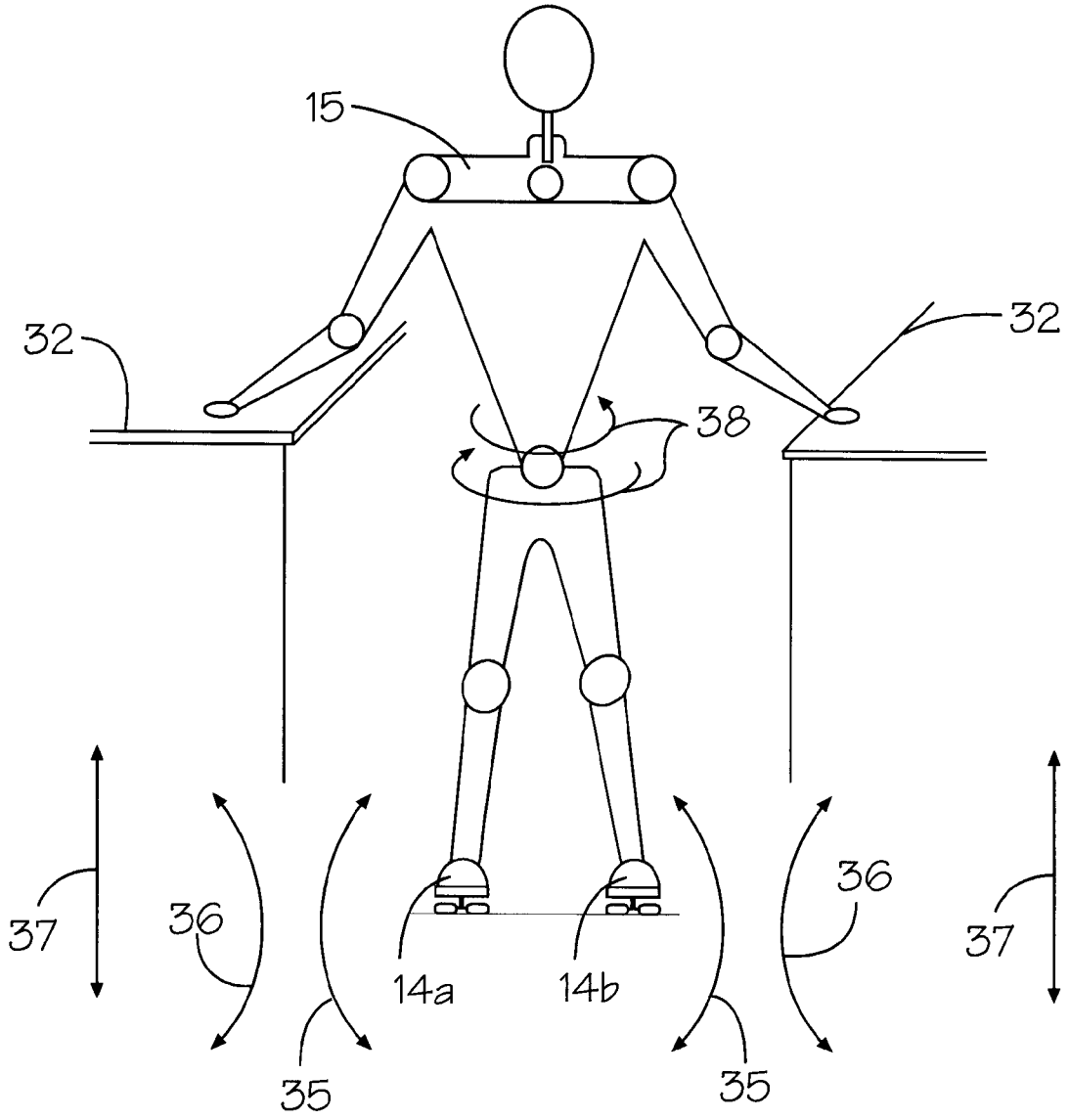
FIG. 8*a* depicts a schematic perspective view of an individual using the apparatus shown in FIGS. 2*a* through 2*c* to exercise the upper and lower body using a twisting motion.

Referring to FIG. 8*a*, the roller bases are used in a manner similar to roller skates, wherein the individual 15 affixes the roller bases to his feet, and braces himself by holding steady to the side panels 32. The individual can then move his legs in an arcuate, back and forth motion, as shown by arrows 35 and 36. The individual 15 can simultaneously move his body or feet up and down, as shown by arrows 37, or can twist his body back and forth, as shown by arrows 38.

Figure 8B:
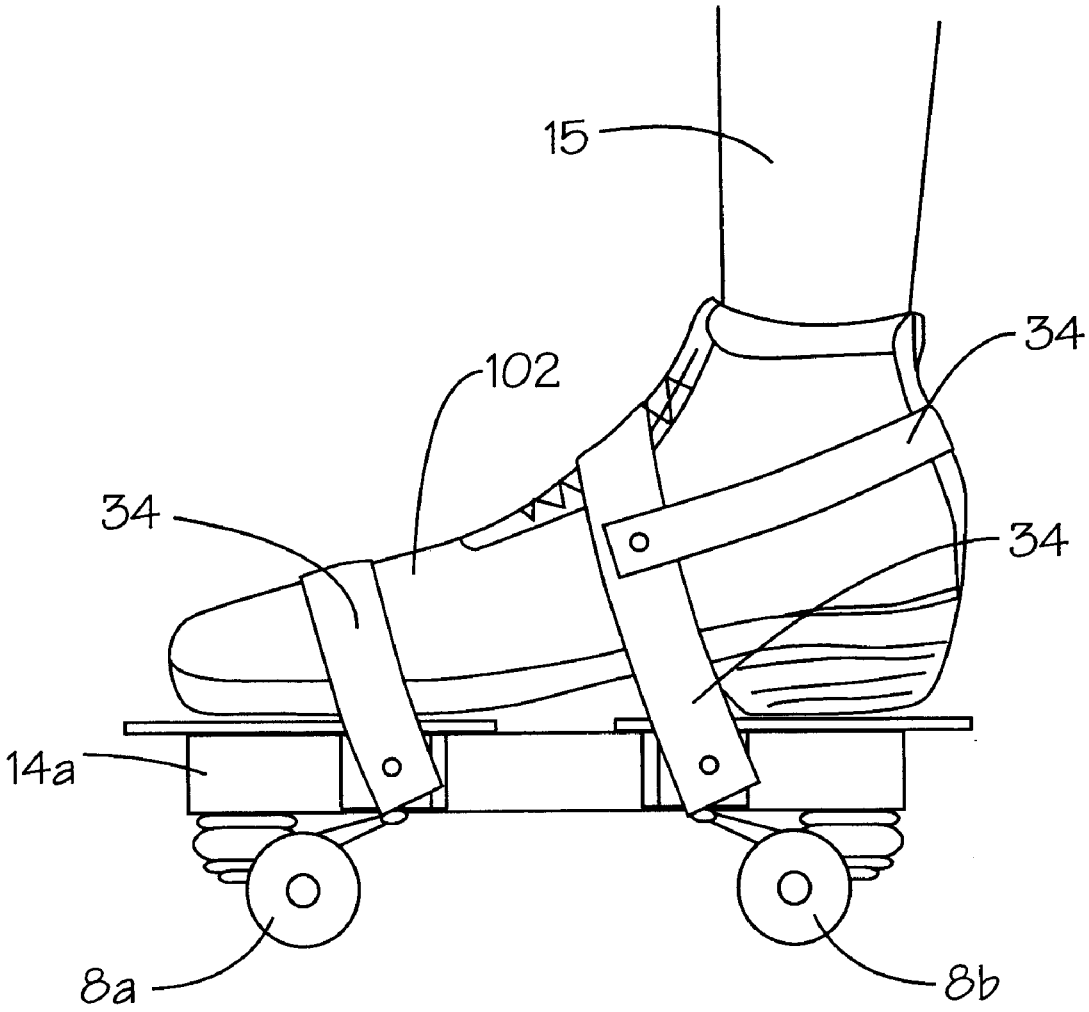
FIG. 8*b* is a side view of an individual's foot attached to a roller pair.

Referring to FIG. 8*b*, the roller base 14*a* can accept a foot 102 of the user 15, which is secured by straps 34, which may be elastic and self-adhering, such as by hooks and loops, as are well known in the art.

Figure 9A:
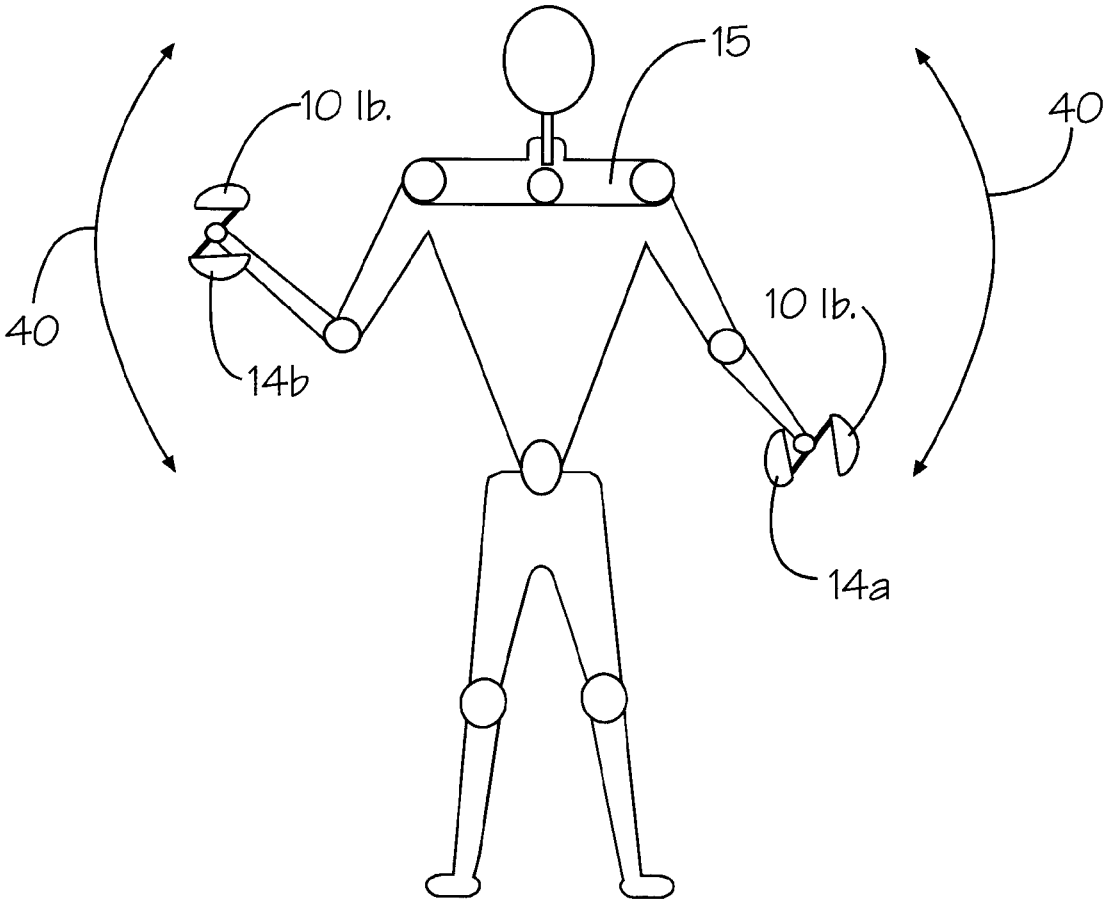
FIG. 9*a* shows a front schematic view of an individual using the apparatus illustrated in FIGS. 2*a* through 2*c* as barbells.
Figure 9B:
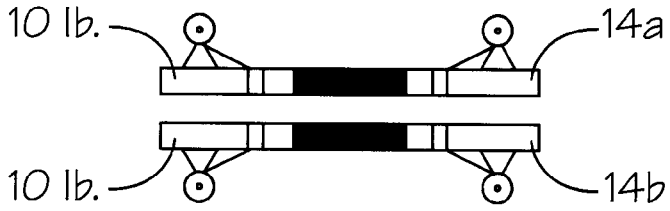
FIG. 9*b* is a cross-sectional view of the roller pairs.

Referring to FIGS. 9*a* and 9*b*, the roller bases 14*a* and 14*b* can be weighted (10 lb.) and can be lifted, similar to using barbells, as shown by arrows 40.

Figure 10A:
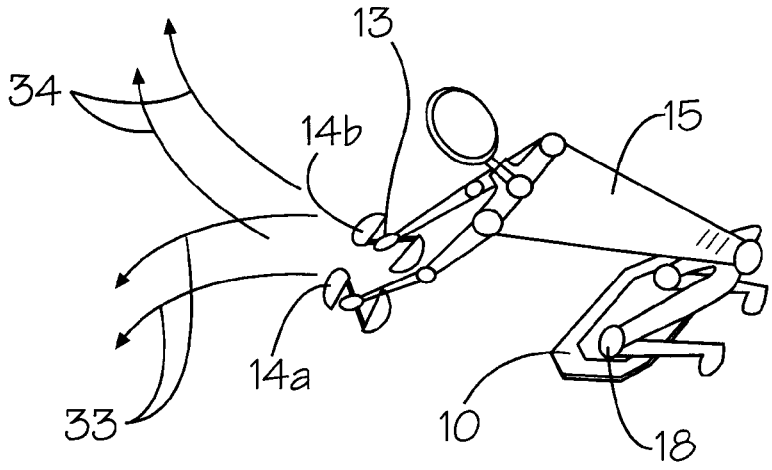
FIGS. 10*a* and 10*b* depict the use of roller bases with rollers turned to predetermined positions.
Figure 10B:
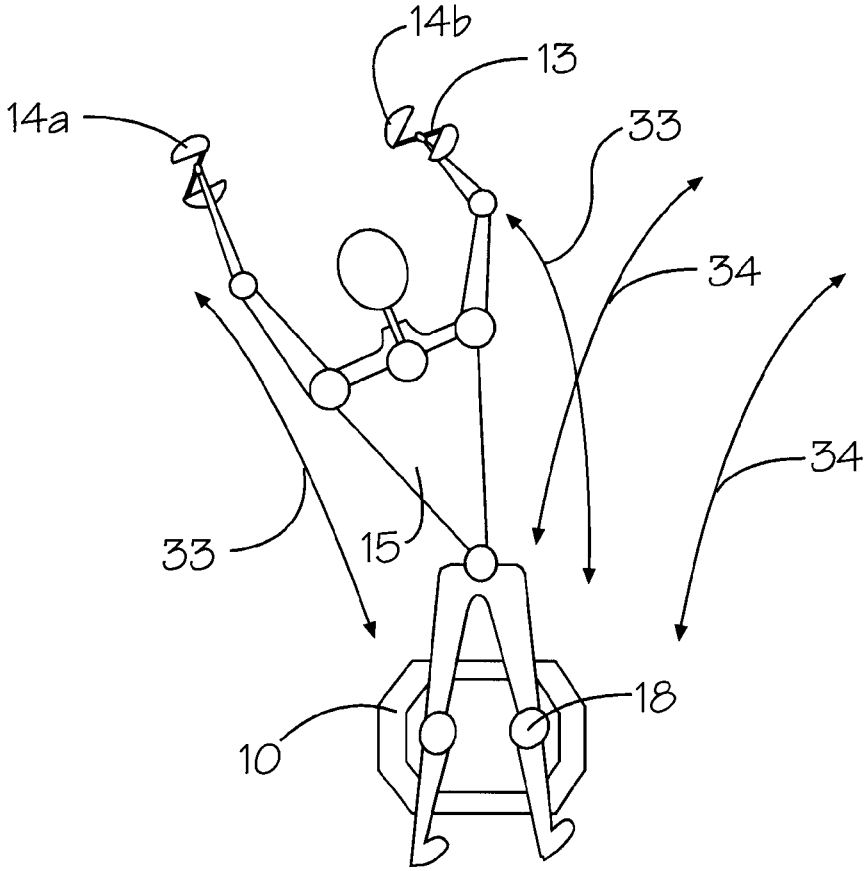

Referring to FIGS. 10*a* and 10*b*, a user 15 can position his knees 18 on platform 10 while rolling one or two roller bases 14*a* and 14*b*. Individual rollers 8*a* and 8*b* can be turned left or right to predetermined positions at an angle relative to the major axis of the roller base 14*a*, 14*b*. The user 15 can operate each roller base 14*a* and 14*b* from its normal position (forward roller moving away from user) or can turn the roller base 14*a*, 14*b* 180° to operate it from its opposite position (forward roller becoming the rear roller), as shown by arrows 33 and 34, for example.

Figure 11A:
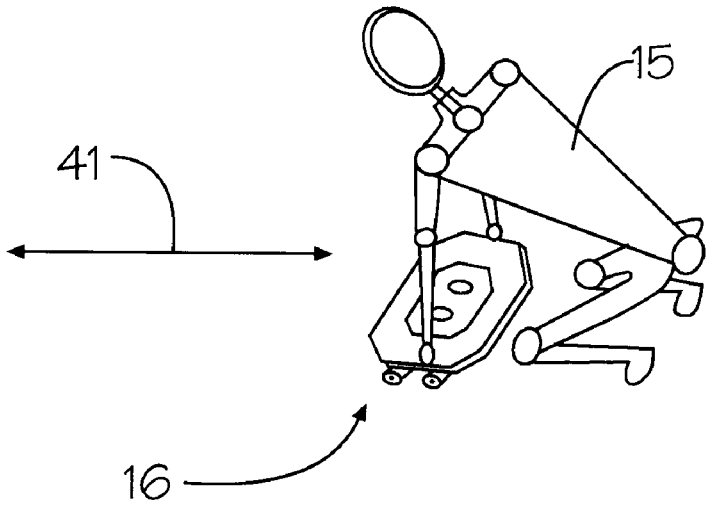
FIGS. 11*a* and 11*b* depict a perspective, schematic view of an individual using the roller pairs attached to the roller base shown in FIG. 1*a*.
Figure 11B:
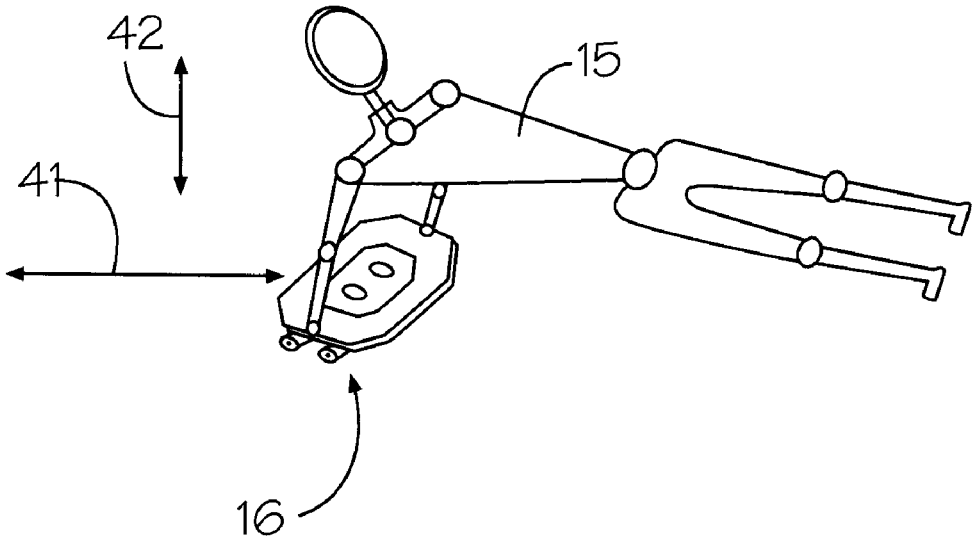

Referring to FIGS. 11*a* and 11*b*, the user 15 can operate the rolling platform 16 as a unitary structure in a back and forth motion, as shown by arrows 41. Similarly, the user 15 can perform pushups, raising his body substantially vertically relative to the floor as shown by arrows 42, FIG. 11*b*. The user 15 can also operate the rolling platform 16 on an inclined surface, providing guide rails, if necessary. This activity accelerates muscle toning, as the user can work against the forces of gravity to his or her benefit.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An exercising system, comprising:

a pair of roller bases having a handle disposed diagonally between front and rear wheel portions, said handle providing an improved grip that reduces wrist strain during work-outs; and a platform having depressions on the lower surface thereof conforming to said roller bases, for nesting said roller bases within the platform.

2. The exercising system in accordance with claim 1, wherein said platform comprises depressions on the upper surface thereof, shaped to accommodate the knees of an individual kneeling upon said platform.

3. The exercising system in accordance with claim 1, wherein said roller bases are sufficiently weighted so that they can be used like barbells.

4. The exercising system in accordance with claim 3, further comprising removable weights for use with said roller bases.

5. The exercising system in accordance with claim 1, wherein said roller bases have means for securing them to the feet of an individual, and can operate in a skate mode.

6. The exercising system in accordance with claim 1, wherein said front wheel positions can be oriented in predetermined positions relative to a major axis of said roller base.

7. A torso roller device, comprising:

a base having front and rear portions having wheels rotatively affixed thereto, for moving said base about a floor, wherein said base has means for securing it to the foot of an individual, and can operate in a skate mode; and a handle disposed at a diagonal between said front and rear portions of said base, for holding said base and rolling same about said floor.

8. The torso roller device in accordance with claim 7, wherein said base and said handle are weighted to provide usage as a barbell.

9. The torso roller device in accordance with claim 7, further comprising a platform upon which said base can be placed.

10. The torso roller device in accordance with claim 7, wherein said wheels can be positioned relative to the major axis of said base for providing arcuate roller movement thereof.

11. The torso roller device in accordance with claim 1, wherein said base comprises two major portions semi-permanently connected to one another.

12. The torso roller device in accordance with claim 11, further comprising hardware for affixing each of said major portions of said base to one another to form a unitary structure.

* * * * *